US007685695B2

(12) United States Patent
Kishi

(10) Patent No.: US 7,685,695 B2
(45) Date of Patent: Mar. 30, 2010

(54) METHOD OF PRODUCING A SPEAKER

(75) Inventor: Kawori Kishi, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 135 days.

(21) Appl. No.: 11/807,104

(22) Filed: May 25, 2007

(65) Prior Publication Data

US 2007/0289120 A1 Dec. 20, 2007

(30) Foreign Application Priority Data

Jun. 1, 2006 (JP) ..... 2006-153794

(51) Int. Cl.
*H01R 31/00* (2006.01)

(52) U.S. Cl. ..... 29/594; 29/609.1; 156/73.1; 156/250; 156/267; 156/292; 156/293; 381/113; 381/116; 381/174; 381/191; 264/212; 264/216; 264/320; 264/323

(58) Field of Classification Search ..... 29/594, 29/830, 840, 609.1; 156/73.1, 250, 267, 156/292, 293, 297; 264/212, 216, 320, 323, 264/331.12; 381/113, 116, 174, 182, 186, 381/191
See application file for complete search history.

(56) References Cited

U.S. PATENT DOCUMENTS 5,106,928 A * 4/1992 Skoultchi et al. ..... 526/196
5,961,762 A * 10/1999 Zelinka et al. ..... 156/164
6,420,467 B1 * 7/2002 Ohtsuka et al. ..... 524/314

FOREIGN PATENT DOCUMENTS

JP 200435590 * 2/2004
JP 2005-039405 2/2005

* cited by examiner

*Primary Examiner*—Paul D Kim
(74) *Attorney, Agent, or Firm*—Ladas & Parry LLP

(57) ABSTRACT

A method of producing a speaker which is manufactured by bonding a plurality of speaker components, including steps of humidifying a joint portion which bonds at least two speaker components among the plurality of speaker components; and bonding the speaker components by humidifying the joint portion and thereafter painting a moisture-curable adhesive on the joint portion, to thereby reduce a time for bonding the speaker components by easily and quickly drying regardless of materials of the speaker components.

9 Claims, 5 Drawing Sheets

METHOD OF PRODUCING A SPEAKER

BACKGROUND OF THE INVENTION

1. Field of the Invention

The present invention relates to a technical field of producing a speaker used by various audio equipments.

2. Related Art

One type of speaker disclosed in Japanese Unexamined Patent Publication No. 2005-39405 is typically constructed to include a magnetic circuit, formed by laminating and connecting a lower plate having a center pole, a ring-like magnet, and a ring-like upper plate. A frame is connected to this magnetic circuit. Further, a voice coil is connected so that the voice coil is placed inside a magnetic gap of the magnetic circuit. Further, a damper is connected to the frame. Thus the damper, the voice coil and the corn are connected. Further, an edge is connected to the frame. As described above, when these speaker components are connected, a bond is ordinarily used. Specifically, the bond is an organic solvent containing bond or a moisture-curable adhesive. However, since the organic solvent containing bond contains an organic solvent, it is necessary to spend a long time for sufficiently drying the bond and adhering each of the speaker components. Further, it is necessary to spend a long time for sufficiently dry the bond and adhere the speaker components when the moisture-curable adhesive is used without sufficiently supplying humidity or moisture. Therefore, when such the speaker is manufactured on a production line, each of the speaker components is adhered, the speaker component thus adhered is dropped once from the production line and is subjected to drying at a location other than the production line. Then the speaker is again carried in the production line to thereby bring over to a succeeding process. Therefore, it is necessary to prevent flow of the production line. Further, it is necessary to additionally prepare a place for drying the speaker components. Thus a cumbersome work occurs.

Accordingly, in order to solve the above problem, when the moisture-curable adhesive is used. There has been developed a method of painting a water-based paint on a joint portion of bonding the speaker components, painting the moisture-curable adhesive thereon, and then adhering the speaker components each other. In use of this method, it is possible to faster dry the bond and reduce a time for drying the speaker components thereby reducing a time necessary for adhering the speaker components each other.

However, in a case where the speaker component is a hard-to-bond material, it is necessary to provide a pre pretreatment like plasma jet for spreading the water-based paint while maintaining a wet condition of the paint.

SUMMARY OF THE INVENTION

It is therefore an object of an illustrative, non-limiting embodiment of the present invention to provide a method of producing a speaker which can quickly and easily dry a bond regardless of materials of speaker components, and reduce a time for bonding the speaker materials.

According to a first aspect of an illustrative, non-limiting embodiment of the present invention, there is provided a method of producing a speaker by adhering a plurality of speaker components each other, including:

a humidifying process of humidifying a joint portion by adhering at least two of the speaker components each other, and an adhering process of painting a moisture-curable adhesive on the joint portion to adhere the speaker components each other after the joint portion is humidified.

DESCRIPTION OF THE PREFERRED EMBODIMENTS

Preferred embodiments of the present invention will be described in conjunction with figures. Hereinafter, each designation of numerical references in the figures is typically as follows:

1: magnetic circuit; 2: center pole; 3: lower plate; 4: ring-like magnet; 5: upper plate; 6: frame; 7: magnetic gap; 8: voice coil; 9: damper; 10: cone; 11: edge; 12: diaphragm; 13: heat and humid steam vent; 20: main main body; 30: humidifying casing on line; and 40: speaker.

The present invention is to provide a method of easily and quickly drying a moisture-curable adhesive hereinafter referred to as a bond, irrespective of a material of speaker member in producing the speaker using a plurality of speaker components and the bond. As such by quickly drying the bond to thereby reduce a time for sufficiently bond the speaker components, it is possible to quickly produce the speaker. Further, when a speaker is produced on a production line, because the bond can be quickly dried, it is unnecessary to remove the speaker components out of the line and move these to a location other than the line to thereby dry the speaker components. Accordingly, it is possible to quickly produce the speaker without disturbing a flow of the line. Further, it is possible to easily and quickly dry the bond regardless of a material of speaker.

According to a method of the present invention, a humidifying step and a bonding step are provided.

Figure 1:
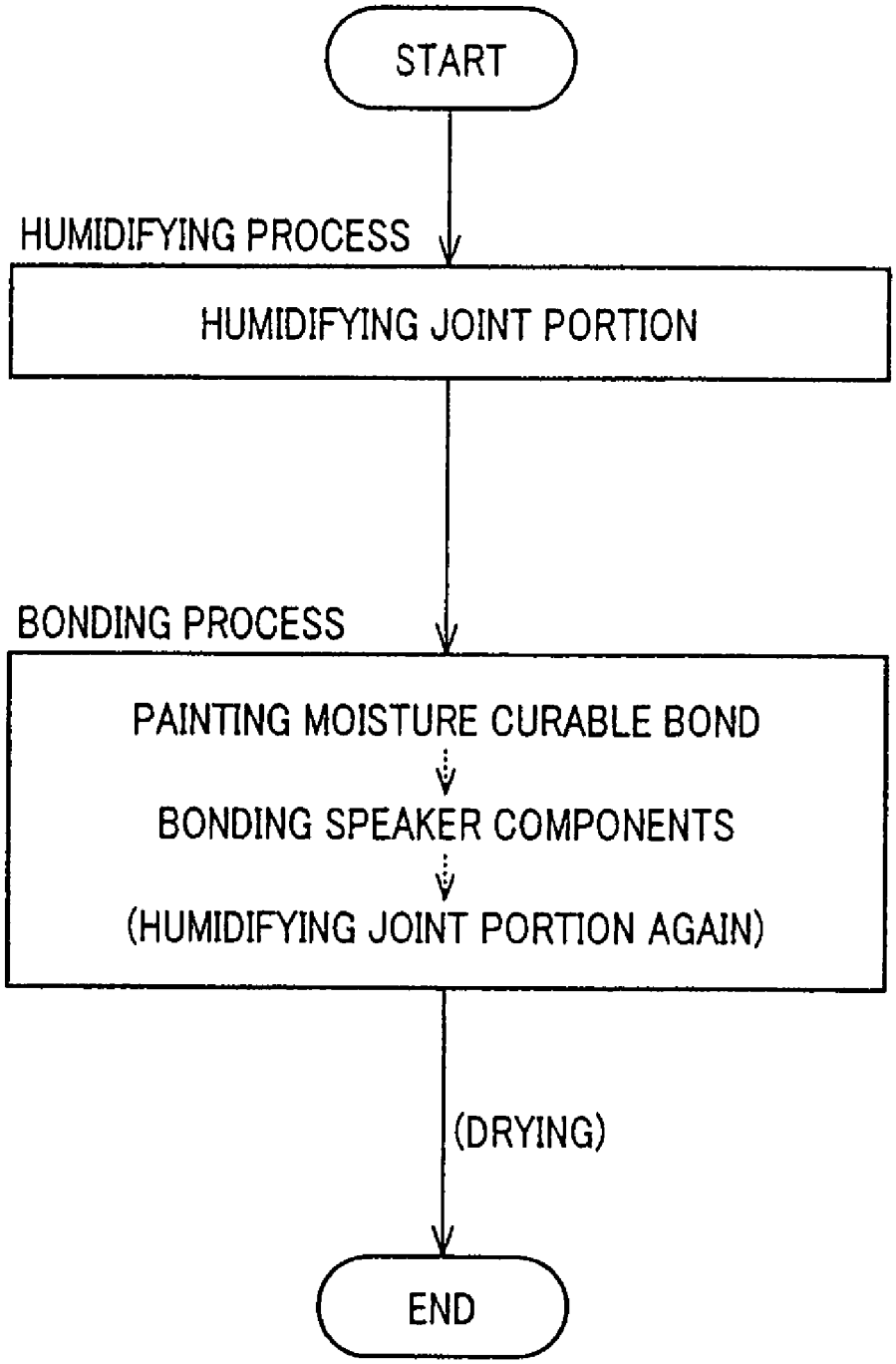
FIG. 1 is a flow chart for explaining a production method of speaker.

FIG. 1 is a flowchart for sequentially explaining steps of a production method of a speaker according to the present invention.

First, the humidifying step is explained in reference of FIG. 1.

(Humidifying Step)

The humidifying step in the method according to the present invention is to humidify a joint portion where at least two speaker components among a plurality of speaker components are bonded among the plurality of speaker components.

By providing the humidifying process as such, it is possible to promote curing of the bond. Namely, after promoting the curing of the bond, the speaker components can be bonded to thereby quickly dry (cure) the bond. Thus it is possible to shorten a time necessary for sufficiently bonding the speaker components. Hereinafter, for easy of explanation, among a plurality of speaker components (for example, speaker components (not shown) A, B, C, D, . . . ), a basic speaker component is referred to as a speaker component A, and other speaker components bonded to the speaker component A are referred to as speaker components B, C, D, . . . .

In this, a joint portion for connecting at least two of a plurality of speaker components A, B, C and D is humidified, an effect of the present invention is obtainable. Namely, by humidifying only the joint portion for bonding the speaker component A and the speaker component B, drying of the bond at the humidified portion (the joint portion between the speaker components A and B) is enhanced thereby shortening a time necessary for sufficiently bonding the speaker components A and B. Hereinafter, only a case where the joint portion between the speaker components A and B is humidified will be described. When only a joint portion of predetermined speaker components is humidified in bonding a plurality of speaker components, it is possible to arbitrarily determine a joint portion to be humidified for bonding which speaker components (e.g. speaker components A and B) are bonded in consideration of materials, positions or the like of the speaker components. As a matter of course, it is possible to humidify all joint portions of bonding the plurality of speaker components. In this occasion, a bond for bonding the plurality of speaker components (speaker components A, B, C, and D) are quickly dried to thereby obtain a further effect of the present invention.

A method of humidifying the speaker components is not specifically limited. For example, the speaker components having the joint portion may be provided inside a space where steam of heat and humidity is filled. When the speaker is produced in a production line, speaker components may be passed through a space filled with steam of heat and humidity. In this, the speaker components to be passed through the space filled with steam of heat and humidity may be the speaker component A, being a basic speaker component, or a speaker component B, being another speaker component which is bonded to the speaker component A. By humidifying the joint portion of the speaker component, it becomes possible to promote curing of the bond to be later painted on the joint portion. Of course, both of the joint portions of the speaker components A and B may be humidified.

As described above, the method of providing the space filled with the steam of heat and humidity is carried out by separating a predetermined region and making a hermetic space for blocking movement of air. Specifically, the hermetic space can be made such that a predetermined portion on the line is covered by vinyl or surrounded by a resin plate. For example, a method of filling the space with the steam of heat and humidity is carried out by providing an exhaust nozzle for blowing out the steam of heat and humidity into the space and filling the space with the steam of heat and humidity. Further, as another method of humidifying the speaker component is to blow the steam of heat and humidity directly onto the joint portion. By this, an effect similar to the above case is obtainable. According to the method, it is also applicable to simultaneously fill the space with the steam of heat and humidity.

In this, a temperature of the steam of heat and humidity is not specifically limited but preferably a room temperatures or more. For example, it is preferably 30 to 60 degrees C., more preferably 35 to 45 degrees C. A humidity at the time is not specifically limited but preferably the humidity of air or more. For example, the humidity is preferably 35 to 80 percent, more preferably 50 percent or more. When moisture of one percent or more of an amount of bond, which is painted on the joint portion, is supplied by humidifying the joint portion with the steam of heat and humidity having such the temperature and humidity, reactivity of the bond to be painted later is extremely improved thereby promoting curing of the bond. Meanwhile, although curing can be proceeded with only moisture existing in air and without humidifying, reaction remains slow and scattering occurs in the reaction speed because of temporal response variation of the humidity. Therefore, by humidifying under the above-described condition, a stable curing speed is obtainable and the productivity is improved. Further, a time for humidifying the joint portion in an atmosphere filled with the steam of heat and humidity is preferably ten to thirty seconds.

As shown in FIG. 1, according to the method of the present invention, the bonding process is carried out next.

(Bonding Process)

The bonding process in the present method is to bond the speaker components by painting a moisture-curable adhesive to a joint portion. As described, by providing the humidifying process described above, it is possible to quickly dry (cure) the bond since the speaker components can be bonded in the bonding process after promoting curing of the bond.

First, the moisture-curable adhesive is painted on the joint portion.

Here, the speaker components painted by the moisture-curable adhesive may be the speaker component A, being the basic component or the speaker component B, being the other speaker components to be bonded to the speaker component A.

The method of painting the moisture-curable adhesive to the joint portion is not specifically limited, and a method conventionally used can be used to paint. An amount of the moisture-curable adhesive to be painted is not specifically limited as long as the speaker components are sufficiently bonded. The moisture-curable adhesive thus used may be a modified silicone moisture-curable adhesive, an urethane moisture-curable adhesive or the like. Especially, it is preferable to use modified silicone moisture-curable adhesive. For example, it is preferable to use 1: Super X No. 8008 manufactured by Cemedine Co., Ltd.; 2: Super X No. 8008L (having a lower viscosity than the above 1) manufactured by Cemedine Co., Ltd.; and Prestor Z104 manufactured by Denki Kagaku Kogyo K.K.

Next, the speaker components are bonded.

The speaker component A having the moisture curable bond painted on its joint portion is bonded to the speaker component B. Thereafter, in order to sufficiently bond the speaker components thus bonded, the speaker components and the bond are sufficiently accoutomed.

Next, the joint portion is again humidified.

By this, since it is possible to further promote curing of the moisture-curable adhesive by humidifying the joint potion after the bonding, the bond can be quickly dried thereby shortening a time necessary for sufficiently bonding the speaker components. Because the method of humidifying the speaker components, the method of forming the space filled with the steam of heat and humidity, and various conditions such as temperature, humidity and humidifying time of the steam of heat and humidity are the same as those described above, explanation is omitted. A humidifying process after the bonding is arbitrarily determined. For example, when it is better not to avoid excessively humidifying the speaker components depending on materials of the speaker components A and B, it may be possible not to humidify the joint portion again at this stage.

Next, the joint portion is dried. The method of drying is not specifically limited. One example is air blasting of warm air. A time for drying is 15 to 120 minutes, preferably 15 minutes.

Here, the speaker components to be humidified and bonded are not specifically limited. For example, such the component is a diaphragm having a main body having a mechanical structure (hereinafter referred to as a main body), a damper, a cone, an edge or the like, as described below. The main body corresponds to the speaker component A described above, and the damper, cone, edge or the like correspond to the above mentioned speaker components B, C, and D described above. Hereinafter, to further specifically describe the present invention, cases where (I) the damper is bonded to the main body (frame portion), and thereafter a case where the main body is bonded to the main body (frame portion) will be described.

(I) Case where the Damper is Bonded to Main Body (Frame Portion)

Figure 2:
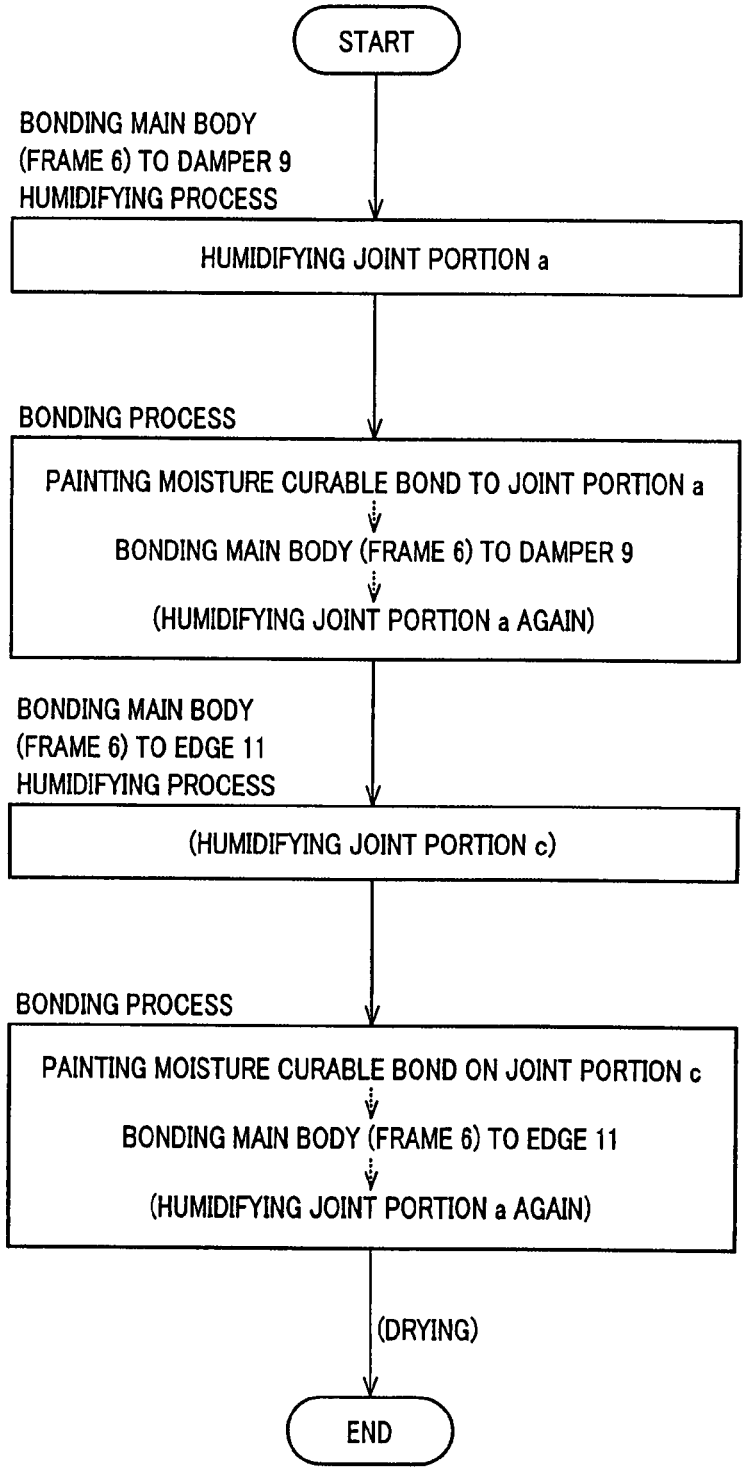
FIG. 2 is a flow chart for explaining a production method of speaker.
Figure 3A:
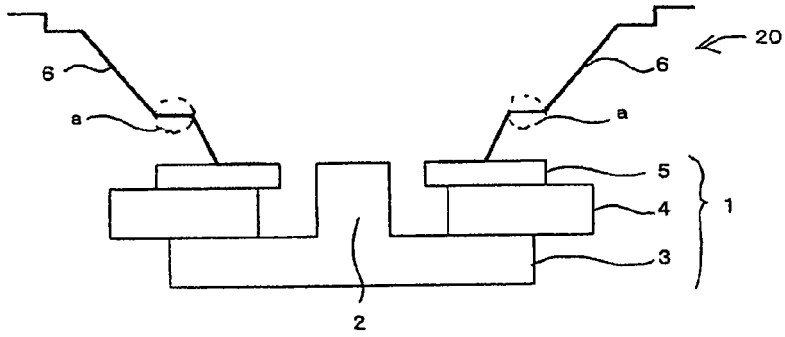
FIG. 3*a* shows a main body of speaker at a time of starting production of the speaker.
Figure 3B:
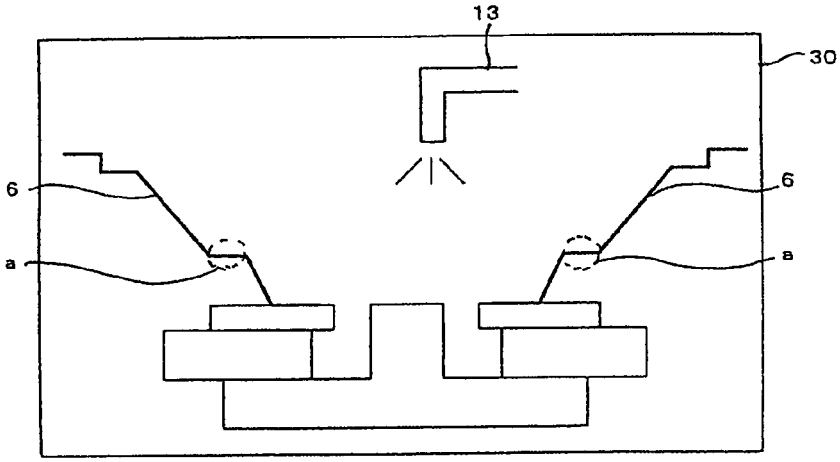
FIG. 3*b* shows when a joint portion is humidified.
Figure 3C:
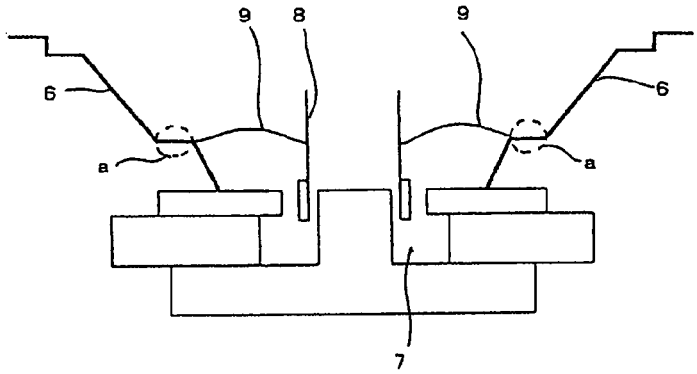
FIG. 3*c* shows a state that a damper is adhered to the main body (frame portion).
Figure 3D:
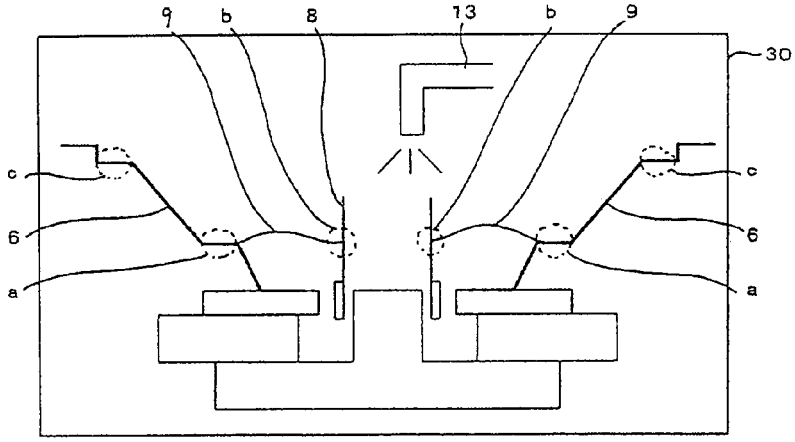
FIG. 3*d* shows a state that the joint portion is humidified after the joint potion is adhered.

FIG. 2 is a flow chart for explaining a method of producing a speaker according to the present invention in order of steps of a production method of the present invention. FIG. 3*a* shows a main body of a speaker when production of the speaker is started. FIG. 3*b* shows a state when a joint portion is humidified. FIG. 3*c* shows a state that a damper is bonded to the main body (portion of frame). FIG. 3*d* shows a state that the joint portion is humidified after bonding the joint portion.

(Humidifying Process)

As shown in FIG. 3*a*, the main body 20 at a time of starting production of the speaker is formed by connecting a frame 6 to a magnetic circuit 1, constructed by laminating and mutually connecting a lower plate 3 having a center pole 2, a ring-like magnet 4, and a ring-like upper plate 5. A damper is bonded to the main body 20 (portion of frame 6) (the joint portion a). Hereinafter, detailed explanation is given.

First, the joint portion a is humidified.

The method of humidifying the joint portion a is not specifically limited to that described above. For example, when the speaker is produced in a line production, as shown in FIG. 3*b*, the main body (frame portion) is let through a space (a humidifying casing 30 on the line) filled with steam of heat and humidity. By this, it is possible to humidify the joint portions a. A method of forming a space for filling it with the steam of heat and humidity, a method of filling the space with the steam of heat and humidity, and so on are similar to the cases described above. An exhaust nozzle for blowing out the steam of heat and humidity 13 is provided inside a humidifying case 3 for filling the steam of heat and humidity inside the space. A temperature of the steam of heat and humidity at a time of humidifying the joint portion a is not specifically limited. The temperature can be arbitrarily determined depending on material of the frame 6. Specifically, the material for the frame 6 is not limited. For example, an iron plate (provided with zinc plating or painting), ABS-PBT, PP (containing glass fiber), or the like can be mentioned. The temperature of the steam of heat and humidity at the time of humidifying the joint portion a is preferably 30 to 60 degrees C., more preferably 35 to 45 degrees C. A humidity of the steam of heat and humidity at the time is preferably 35 to 80%, more preferably 50% or more. Further, a time of humidifying the joint portion a in a space filled with the steam of heat and humidity is preferably 10 to 30 seconds. In this, the voice coil is in advance connected by a known method to engage a voice coil 8 in a magnetic gap 7 of a magnetic circuit before bonding the main main body (frame portion 6) and the damper 9. (vide FIG. 3*c*)

(Bonding Process)

First, a moisture-curable adhesive is painted on the joint portion a of the main body (frame portion 6).

A method of painting the moisture-curable adhesive of the joint portion a is not specifically limited and a known method can be used to paint. An amount of the moisture-curable adhesive is not specifically limited. An amount sufficient for bonding the main body (frame portion 6) and the damper 9 works. The moisture-curable adhesive to be used is similar to a case described above.

Next, the main body (portion of frame 6) and the damper are bonded.

After painting the moisture-curable adhesive on the joint portion a of the main body (frame portion 6), the damper 9 is bonded to a position substantially parallel to the ring-like magnet 4 and in contact with a part of the voice coil 8, as shown in FIG. 3*c*. Thereafter, the frame 6 and the damper 9 are accustomed with the bond sufficiently to firmly bond the damper 9. In this, a material of the damper 9 is not specifically limited and, for example, that obtained by impregnating a resin to fabric such as Comex, Nomex and cotton can be mentioned.

Next, the joint portion a is again humidified. (vide FIG. 3*d*)

The method of humidifying the joint portion a, the method for forming the space filled with the steam of heat and humidity, and various conditions such as a temperature, a humidity and a humidifying time of the steam of heat and humidity used when the joint portion a is humidified are the same as those described above. Therefore, the explanation thereof is omitted. The process can be arbitrarily provided. If excessive humidification is not preferable, it is unnecessary to humidify again at this stage.

(II) when a Diaphragm is Bonded to a Main Body (Portion of Frame)

Figure 3E:
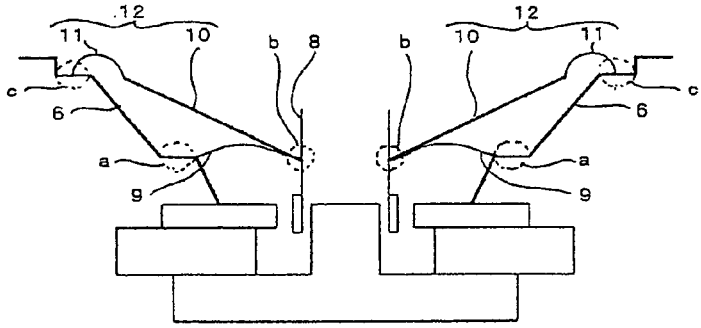
FIG. 3*e* shows a case where a diaphragm is adhered to the main body.
Figure 3F:
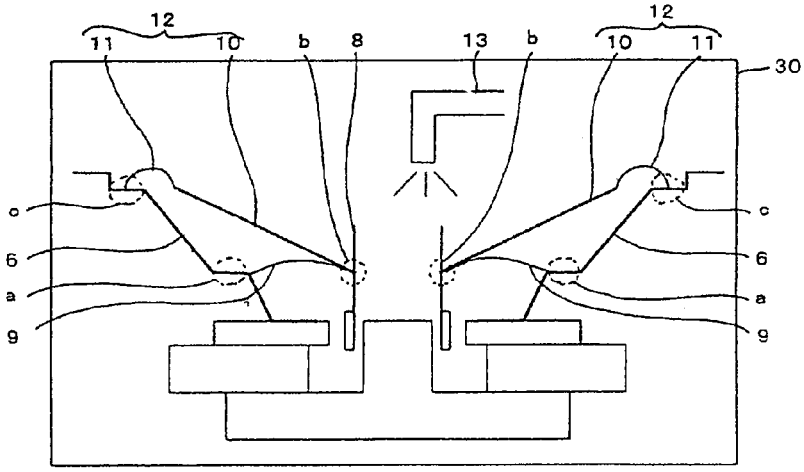
FIG. 3*f* shows a case where the joint portion is humidified.

FIG. 2 shows a flow chart for explaining a method of producing the speaker. FIG. 3*d* shows a case where a joint portion is humidified after the joint portion is bonded. FIG. 3*e* shows a case where the diaphragm is bonded to the main body. FIG. 3*f* shows a case where the joint portion is humidified.

As described above, after the damper 9 is bonded to the main body (frame portion 6), the diaphragm 12 is bonded to the main body. Specifically, another end of the damper 9, previously bonded, is bonded to the cone 10 of the diaphragm 12 at a joint portion b, and simultaneously an edge 11 of the diaphragm 12 is bonded to the main body (portion of frame 6) at a joint portion c. Here, when the other end of the damper 9, which is previously bonded to the main body (voice coil portion 8), is bonded to the cone 10 of the diaphragm 12, it is bonded by an adhesive which is conventionally used to bond speaker components. When the edge 11 of the diaphragm 12 is bonded to the main body (portion of frame 6), the method of the present invention is used to bond by a moisture-curable adhesive. Hereinafter, a case where the edge 11 of the diaphragm 12 is bonded to the main body (frame portion 6) will be described in detail in use of the present invention.

(Humidifying Process)

First, the joint portion c is humidified.

The method of humidifying the joint portion c is not specifically limited as described above. For example, when speakers are manufactured in line production, speakers are passed through a space filled with the steam of heat and humidity. By this, the joint portion c is humidified. As described, when the joint portion c is again humidified after the main body (portion of frame 6) and the damper 9 are bonded as described above, the joint portion c may be simultaneously humidified. In a case where the joint portion a is not again humidified after bonding the main body (frame portion 6) and the damper 9, it may be possible to further provide a step of humidifying the joint portion c. The method of forming the space filled with the steam of heat and humidity, the method of filling the space with the steam of heat and humidity, or the like is similar to those described above.

Here, a temperature of the steam of heat and humidity at a time of humidifying the joint portion c is not specifically limited. However, it can be arbitrarily set up depending on material of the damper 9 or the like. The humidity of steam of heat and humidity is preferably 30 to 60 degrees C., more preferably 35 to 45 degrees C. The humidity of the steam of heat and humidity corresponding to the Celsius degree is 35 to 80%, more preferably 50% or more. Further, it is preferable to set a time necessary for humidifying the joint portion c in the space filled with the steam of heat and humidity. Meanwhile, this process may be arbitrarily provided. When it is better not to humidify too much in consideration of the material of the damper 9, it is unnecessary to humidify the joint portion again at this stage.

(Bonding Process)

First, a moisture-curable adhesive is painted on the joint portion c of the main body.

The method of painting the moisture-curable adhesive on the joint portion c is not specifically limited. It is possible to coat by a conventionally known method. An amount of the moisture-curable adhesive to be painted is not specifically limited, and an amount necessary for bonding the main body (frame 6) and the edge 11 is satisfactory. The moisture-curable adhesive used here is similar to a case described above. Further, since the main body (portion of frame 6) and the edge 11 are bonded and simultaneously the main body (voice coil portion 8), the damper 9 and the corn 10 are bonded. For this, for example, an adhesive conventionally used at a time of bonding speaker components such as acrylic resin material and epoxide resin adhesives is painted on the joint portion b.

Next, the main body (portion of frame 6) and the edge 11 are bonded.

After painting the moisture-curable adhesive on the joint portion c, and the main body (portion of frame 6) and the edge 11 are bonded as shown in FIG. 3*e*. The main body (portion of voice coil 8), the damper 9 and the cone 10 are simultaneously bonded. In this, a material of the edge 11, being a part of diaphragm, is not specifically limited. However, rubber, urethan, cloth (rubber coated) or the like can be exemplified. Further, a material of the cone 10 is not specifically limited. For example, polypropylene, Kevlar, and paper can be exemplified.

Next, the joint portion c is again humidified. (vide FIG. 3*f*)

Because the method of humidifying the joint portion c, the method of forming the space filled with the steam of heat and humidity, and various conditions such as a temperature, a humidity and a humidifying time of the steam of heat and humidity in humidifying the joint portion c are similar to the case described above, description thereof is omitted. Meanwhile, this step can be arbitrarily provided. When it is better not to excessively humidify the diaphragm made of the main body (frame 6), the damper 9, the cone 10 and the edge 11 because of characteristics of these materials, it is unnecessary to humidify the joint portion again at this stage.

Next, the joint portions a, b and c are dried. The method of drying is not specifically limited. However, air blasting of warm air or the like can be mentioned. A drying time is preferably 15 to 120 minutes, more preferably 15 minutes.

Figure 4:
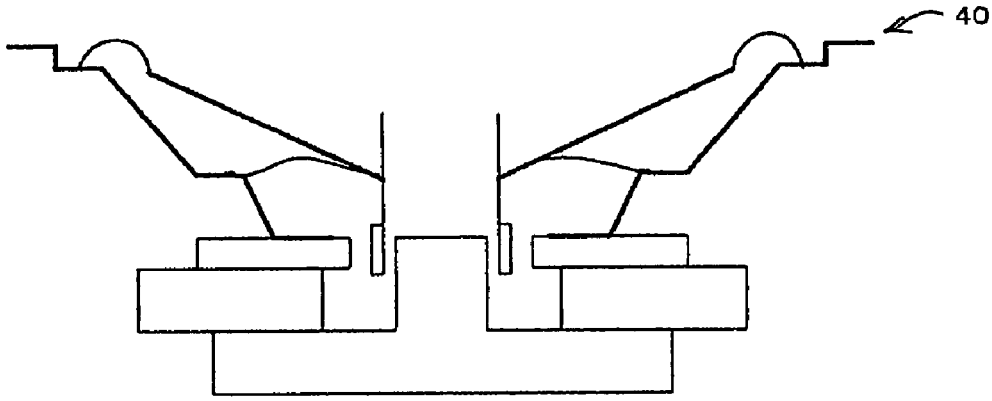
FIG. 4 shows a speaker for explaining it.

By proceeding these processes, the speaker 40 shown in FIG. 4 can be produced.

The present invention is not confined to the configurations listed in the foregoing embodiments, but it is easily understood that the person skilled in the art can modify such configurations into various other modes, within the scope of the present invention described in the claims.

The entire disclosures of Japanese Patent Applications No. 2006-153794 filed on Jun. 1, 2006 including the specification, claims, drawings and summary are incorporated herein by reference in its entirety.

The invention claimed is:

1. A method of producing a speaker which is manufactured by bonding a plurality of speaker components, comprising:

a first humidifying step comprising humidifying a joint portion which bonds at least two speaker components among the plurality of speaker components;

a bonding step comprising bonding the speaker components by humidifying the joint portion and thereafter painting a moisture-curable adhesive on the joint portion; and a second humidifying step comprising humidifying a vicinity of the joint portion again for a predetermined period of time following the bonding step; wherein the first humidifying step comprises humidifying the joint portion by directly squirting steam of heat and humidity towards the joint portion; wherein the second humidifying step comprises humidifying the vicinity of the joint portion by directly squirting steam of heat and humidity towards the vicinity of the joint portion; and wherein said humidifying the joint portion comprises humidifying only the joint portion.

2. The method of producing the speaker according to claim 1, wherein the first and second humidifying steps comprise humidifying the joint portion and its vicinity inside a space filled with steam of heat and humidity.

3. The method of producing the speaker according to claim 1, wherein the first and second humidifying steps are carried out under a relative humidity of 35% to 80%.

4. The method of producing the speaker according to claim 1, wherein the first and second humidifying steps are carried out under a temperature of 30 to 60 degrees Celsius.

5. The method of producing the speaker according to claim 1, wherein the first and second humidifying steps are carried out for a period of time of 10 to 30 seconds.

6. The method of producing the speaker according to claim 1, wherein the moisture-curable adhesive is such that supplying moisture promotes curing of the moisture-curable adhesive bond.

7. A method of producing a speaker which is made up of at least a plurality of speaker components including a main body having at least a mechanical structure, a damper, and a diaphragm having a cone and an edge, comprising:

a first humidifying step of humidifying a joint portion of the main body where at least one of the damper and the edge is bonded to the main body;

a bonding step comprising bonding at least one of the damper and the edge by painting a moisture-curable adhesive on the joint portion of the main body thus humidified; and a second humidifying step comprising humidifying a vicinity of the joint portion again for a predetermined period of time following the bonding step;

wherein said humidifying the joint portion comprises humidifying only the joint portion.

8. The method of producing the speaker according to claim 7, wherein when the damper is bonded to the main body in the first humidifying step, the joint portion of the main body where the damper and the cone are bonded to the main body is humidified; and in the bonding step, the damper and the cone are bonded by painting the moisture-curable adhesive to the joint portion of the main body thus humidified.

9. The method of producing the speaker according to claim 7, wherein the moisture-curable adhesive is such that supplying moisture promotes curing of the moisture-curable adhesive bond.

* * * * *